US006583346B2

(12) United States Patent
Lojacono

(10) Patent No.: US 6,583,346 B2
(45) Date of Patent: Jun. 24, 2003

(54) STOCK-LIKE SINUSOID MEMBERS FOR TUNING A GUITAR

(75) Inventor: Richard Lojacono, Paso Robles, CA (US)

(73) Assignee: Earvana®, LLC, Paso Robles, CA (US)

( * ) Notice: Subject to any disclaimer, the term of this patent is extended or adjusted under 35 U.S.C. 154(b) by 40 days.

(21) Appl. No.: 09/946,862

(22) Filed: Sep. 4, 2001

(65) Prior Publication Data

US 2002/0078815 A1 Jun. 27, 2002

Related U.S. Application Data

(63) Continuation-in-part of application No. 29/097,840, filed on Nov. 14, 1998, now abandoned.

(51) Int. Cl.[7] ..... G10D 3/06

(52) U.S. Cl. ..... 84/314 N; 84/314 R

(58) Field of Search ..... 84/314 N, 314 R, 84/293, 298, 307

(56) References Cited

U.S. PATENT DOCUMENTS 4,311,078 A * 1/1982 Falgares ..... 84/314 R
5,481,956 A * 1/1996 LoJacono et al. ..... 84/314 N
5,750,910 A * 5/1998 LoJacono ..... 84/314 N

* cited by examiner

*Primary Examiner*—Shih-Yung Hsieh
(74) *Attorney, Agent, or Firm*—Patent Law Firm; Peter Jon Gluck

(57) ABSTRACT

A stock-like fixed sinusoidally curved and shaped member is effective for maintaining a zero cent condition and keeping the relative and respective string lengths and individuated pitches and tones contant in any conventional guitar on which the present invetion is installed, methods and kits are likewise disclosed.

20 Claims, 4 Drawing Sheets

STOCK-LIKE SINUSOID MEMBERS FOR TUNING A GUITAR

This is a Continuation-In-Part application of the currently United States Letters Patent Application designated as U.S. Ser. No. 29/097,840 And originally entitled FIXED SINUSOIDAL CURVE filed Nov. 14, 1998 now abandoned by the present inventor. Likewise, the inventor of the present application, Richard J. Lojacono, expressly incorporates by reference each of his related family of provisional patent applications, design patent applications and issued United States Utility Patents as if each of the same were set forth herein:

U.S. Pat. Nos. 5,481,956; 5,750,910; Ser. Nos. 08/934,524; 29/066,560; 09/020,562; 09/021,657; Nos. 60/037,563; 60/117,554.

BACKGROUND OF THE INVENTION

1. Field of the Invention

The present invention relates generally to an apparatus and method for tuning a string-based musical instrument. More specifically, the present invention relates to an apparatus and method for generating and maintaining a zero cent position with respect to the first and twelth frets of any conventionally made electric or acoustic guitar, inter alia, as set forth in each of the U.S. Letters Patents and Applications set forth as incorporated expressly herein.

2. Description of the Prior Art

Since the dawn of recorded history, and likely before that, humanity has accorded high esteem to those whose insights have rendered cogent the processes by which auditory stimuli impact upon the human senses. Assuming that vibrations traveling through the air and perceived by humans are considered as sound, generating euphonic harmonized vibrations came to be known as MUSIC.

In contemporary society those who specialize in creating, recording, and otherwise supporting the business of making and transmitting music have become objects of fame, fortune and glory. It is respectfully proposed that the instant teachings continue this time honored tradition, and accordingly constitute progress in science and the useful arts.

During the Sixth Century, Greek philosopher, musician and scientist Pythagoras set forth the mathematical bases of what has come to be known as the equal tempered scale. According to conventional understanding, tuning of string-based musical instruments uses the equal tempered scale to derive the ratio for each successive semitone on the basis of the twelfth root of two. This is done by dividing the octave into twelve equal semitones, and the frets on the neck of a guitar in such a way as to replicate spatially and geometrically this numerical relationship.

The mythical Pythagoras, while pondering the metes and bounds of the musical scale, happened upon the premises of a blacksmith, and heard chime-like sounds ringing out. Further investigation revealed anvils and hammers ringing out various pitches. Selecting for the variables that were identifiable, Pythagoras eliminated the strength and experience of the men, the types of anvils and was left with the mass of the hammers as determinative of the respective low-ness or bass-ness of the involved pitches. Ever the empiricist, Pythagoras turned to the lutes, or guitar-precursors which were popular at the time.

Variation of string length placed these types of instruments' wind-based pitch successions squarely within the scope of Pythagoran/Mathematical Law. In basic form:

i. the longer the string, the deeper the sound;

ii. the shorter the string, the higher the sound;

iii. any note produced by a string may be halved to produce the same note an octave higher; and, iv. the other notes of the octave lie at fixed points in between.

Fifteen centuries later we have used these quantified relationships in the teachings of the present invention, as defined by the claims which are set forth herein. Since the twelfth root of two is equal to approximately 1.059463, by using this figure in ratio to 1, the modern basis for the equal tempered scale is denoued. In sum, 1.059463: 1 is used as the basis for computing semitone intervals, and the ratio 17:18 (or the 'eighteen rule') dictates that division of a selected string length into eighteen parts means that the distance from the saddle of the bridge to the first fret will equal seventeen parts, and the distance from a nut of the first fret will be equal to 1/18 of the string or scale length. Dividing the remaining distance again into eighteen parts, 1/18 th of that will be the interval between the first and second frets, and this ratio continues to lay out the dimensions of the entire fingerboard. See, for example the background sections of U.S. Pat. Nos. 5,481,956 and 5,750,910, inter alia.

In order to maintain that which is perceived by humans as perfect harmony, however, there must be a Way to maintain and preserve these ideal ratios not only on the fingerboard, but also along the length of each respective string. Taking into account string materials, an adjustable bridge piece and a nut member must be used to gauge the requisite length, tension, mass per unit length (diameter) and the like to create the desired sound. That is, unless the teachings of the present invetion are used.

To date, several valiant and focused attempts to adjust both string length by manipulating the bridge end and the nut end are noted—principally according to the teachings of the present inventor by way of an adjustable and fixed sinusoidal nut or curve. However, the commercial nature of the current guitar business precluded widespread acceptance of any retrofitting system for guitars, and demanded a stock-like sinusoid member as set forth herein.

SUMMARY AND OBJECTIVES OF THE PRESENT INVENTION

According to the teachings of the present invention there is provided a stock-like fixed sinusoidal member effective for maintainging a zero-cent condition and installable on any conventional guitar.

An objective of the present invention is to provide a plurality of stock-like sinusoidal members fittingly engageable with any know guitars, which are ready to be mounted thereupon and sold as original equipment, or retrofitted.

According to a feature of the present invention there is provided a stock-like fixed sinusoidal nut member having a plurality of indentations for receiving the strings of a guitar, whereby placing the member from at least about 0.80 to about 1.80 mm from a first fret of a guitar enables a constant sting length to be maintained.

According to another feature of the present invention there is provided an apparatus for maintaining a pythagoran mathematical relationship between string lengths along a fretboard for use with a guitar comprising a sinusoidally curved member which bracingly enages strings of a guitar within respective sting wells permitting a desinred string tension to be maintained.

According to yet another feature of the present invention there is provided a method of installing a tuning amelioration device for a guitrar having a fretboard, including the steps of providing a fixed sinusoidal member having respective notches for receiving strings, and positioning the member a fixed distance between the proximal end of the guitars' neck portion and a first fret of a fretboard.

Briefly stated, a stock-like fixed sinusoidally curved and shaped member is effective for maintaining a zero cent condition and keeping the relative and respective string lengths and individuated pitches and tones contant in any conventional guitar on which the present invention is installed, methods and kits are likewise disclosed.

BRIEF DESCRIPTION OF THE FIGURES

Various preferred embodiments are described herein with references to the drawings in which merely illustrative views are offered for consideration, whereby.

DETAILED DESCRIPTION OF EMBODIMENTS OF THE INVENTION

The term guitar is believed to be based upon the French term "guitare" derived from the Spanish "guitarra" ostensively based on the Greek kithara (cithara). It has become known to encompass those musical instruments having a large flat backed sound box similar in shape to a violin having a long fretted neck and five or six strings.

Figure 1:
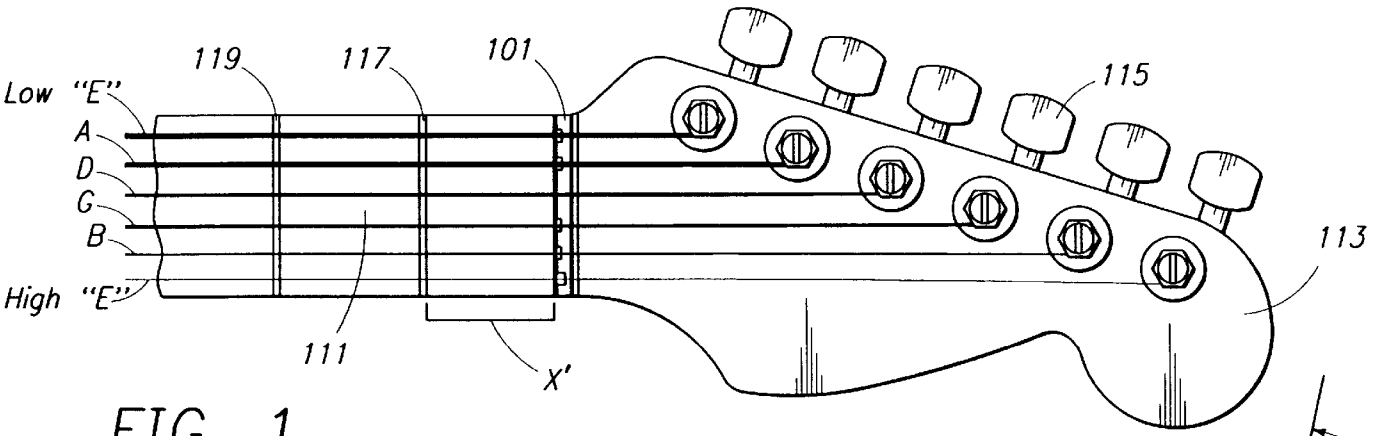
FIG. 1 shows a stock-like fixed sinusoid member installed on a conventional guitar neck, according to teachings of the present invention.

Turning now to FIG. 1, stock-like fixed sinusoid 101 is shown installed on the proximal end 113 of long fretted neck 111 of any known guitar. Those having a modicum of skill in the art will readily understand the use of tuning knobs 115 which impart tension to each of the respective guitar strings which pass over the present invention 101, as shown, before first fret 117 and second fret 119, as the strings travel toward and communicate with remaining frets (not shown) and eventually the terminus of each respective string in the direction of the distal end of long fretted neck 111.

Likewise, those skilled in the art will readily understand and be aware of the musical notes corresponding to the "Low 'E'" to "High 'E'" designations, based upon the plucking, strumming or otherwise causing the respective strings to be intonated, and/or pressed against the fret board of long fretted neck 111 of any known guitar.

Figure 2:
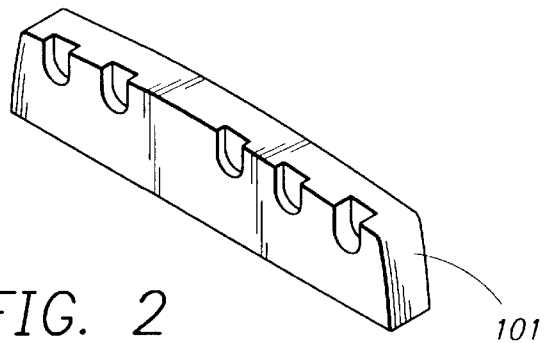
FIG. 2 is a detailed partial perspective frontal plan view of a stock-like fixed sinusoid member identical to that installed on a conventional guitar neck, per FIG. 1, according to teachings of the present invention.
Figure 3:
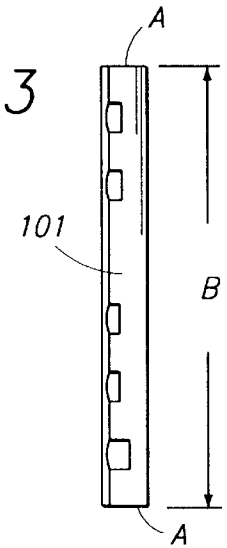
FIG. 3 is a detailed top view of a stock-like fixed sinusoid member identical to that installed on a conventional guitar neck, per FIG. 1, according to teachings of the present invention.
Figure 4:
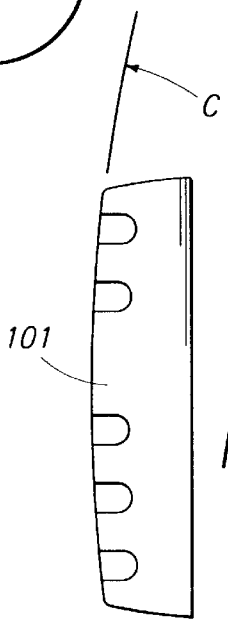
FIG. 4 is a detailed side view of a stock-like fixed sinusoid member identical to that installed on a conventional guitar neck, per FIG. 1, according to teachings of the present invention.

FIGS. 2, 3 and 4 similarly show stock-like fixed sinusoid 101, from a partial perspective, top and full side view. It is noted that stock-like fixed sinusoid 101 is made from a variety of conventional materials having a plastic-base, and is molded, stamped, pressed, carved, melted, thermoset or otherwise created, based upon the particular guitar to which it is designed to be attached. Segmental views along lines "A", "B" and "C' are likewise offered for consideration as showing the nature and shape of stock-like fixed sinusoid 101, which is equipped with a plurality of wells for receiving five of the six string of known guitars.

The view designated "C" shows the curve imparted to the top of stock-like fixed sinusoid 101 allowing it to receive each of the respective strings. Distance X' has been empirically determined to range from at least about 0.80" to about 1.85" according to the instant teachings. Preferred embodiments have placed the distance at about 1.333", according to the present inventor.

Figure 5:
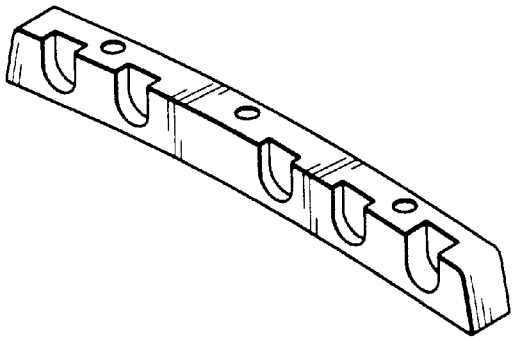
FIG. 5 shows an alternate embodiment of the stock-like fixed sinusoid member invented by applicant in partial perspective plan view.
Figure 6:
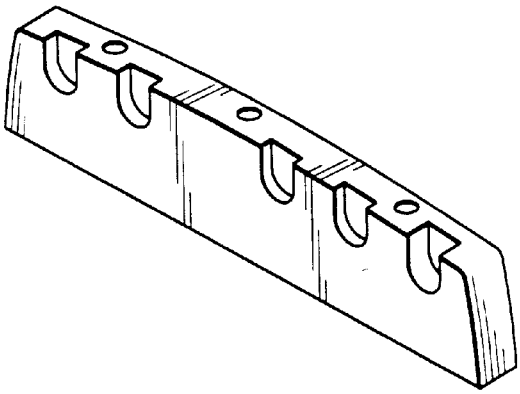
FIG. 6 shows an alternate embodiment of the stock-like fixed sinusoid member invented by applicant in partial perspective plan view.
Figure 7:
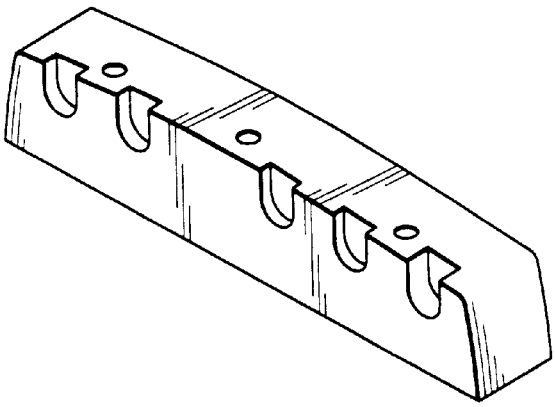
FIG. 7 shows an alternate embodiment of the stock-like fixed sinusoid member invented by applicant in partial perspective plan view.

Referring to FIG. 5, FIG. 6 and FIG. 7 alternate preferred embodiments of stock-like fixed sinusoid 101 are shown (reference designators not shown). Those skilled in the art will understand variations in the guitars to be supported by the teachings of the present invention, and be readily able to select an appropriate stock-like fixed sinusoid 101 to support strings as a bridging and tuning device.

Figure 8:
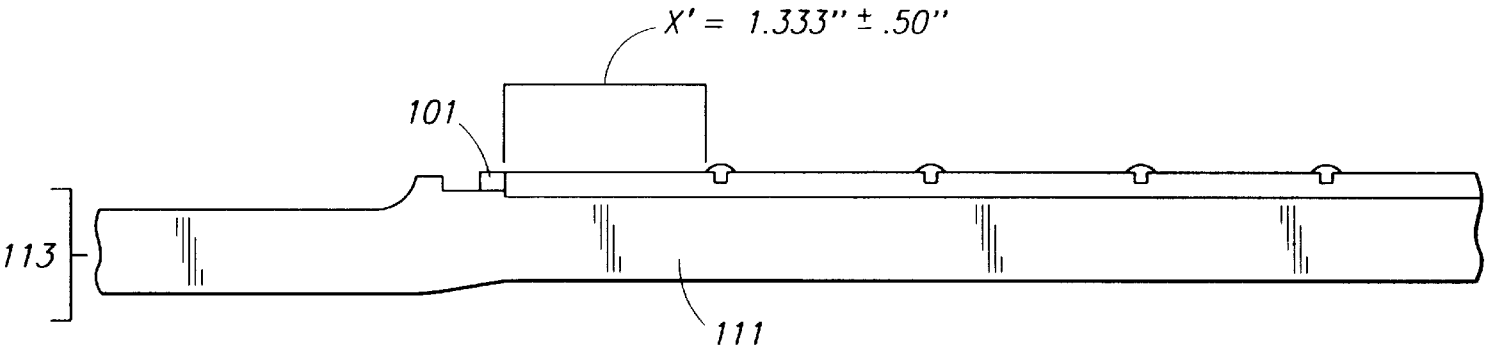
FIG. 8 shows a typical installation of the present invention distal to the first fret on the proximal end of any conenvtional guitar.

FIG. 8 likewise shows stock-like fixed sinusoid 101, aligned between the proximal end 113 of long fretted guitar neck 111 and the first fret. As discussed above, preferred embodiments have placed the distance at about 1.333", according to the present inventor, with a variation of about 0.50" being used to work with all of the embodiments shown above. Those skilled in the art of tuning will be able to understand readily the factors required to adjust the tuning according to the teachings of the present invention.

Figure 9:
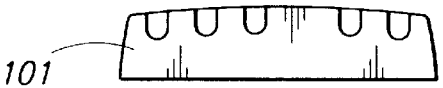
FIG. 9 shows the embodiment installed in FIG. 8 in side view.
Figure 10:
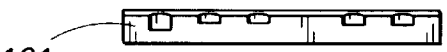
FIG. 10 shows the embodiment installed in FIG. 8 in top view.
Figure 11:
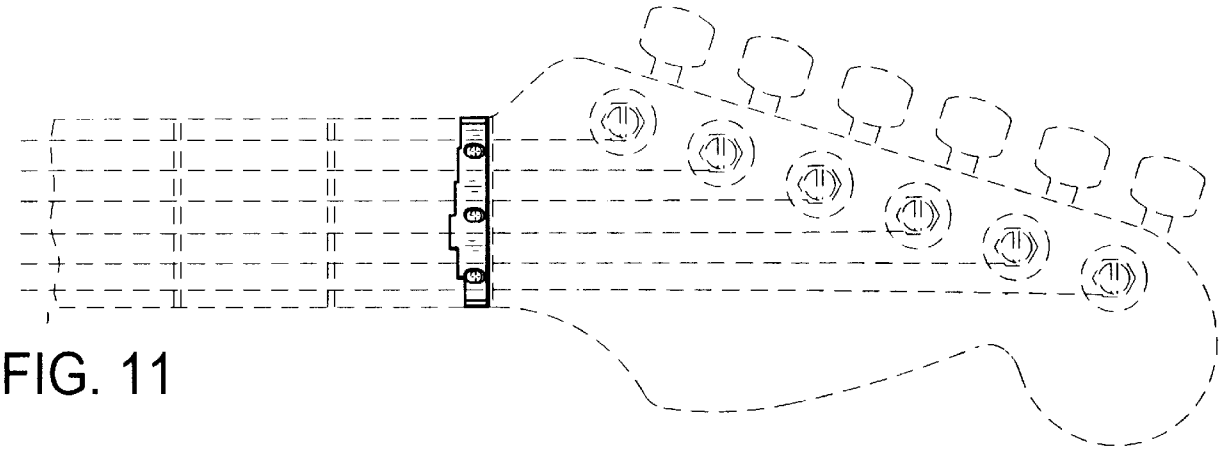
FIG. 11 shows applicant's alternate embodiment of fixed sinusoid member installed on a conventional guitar neck, according to teachings of the present invention.

Each of FIGS. 9 and 10 likewise illustrate stock-like fixed sinusoid 101, which is placed at a distance of at least about at about 0.80" to about 1.333", according to the present inventor, from the first fret of long fretted guitar neck 111.

Referring now to FIGS. 11–14, applicant's original design for a fixed sinusoid member is shown as, mounted on any known guitar, including string guiding and adjusting portions, with a mounting position similar to the preferred embodiments detailed above.

Figure 12:
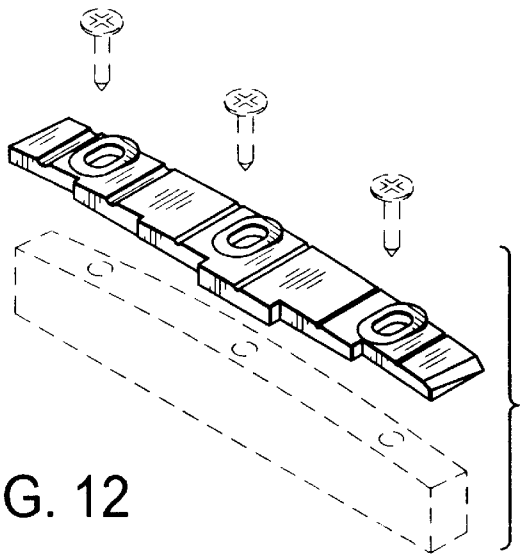
FIG. 12 is a detailed partial perspective frontal plan view of the alternate fixed sinusoid member installed on a conventional guitar neck in FIG. 11, according to teachings of the present invention.
Figure 13:
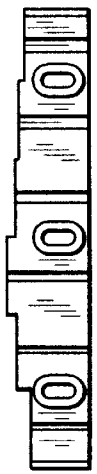
FIG. 13 is a detailed top view of the alternate fixed sinusoid member installed on a conventional guitar neck in FIG. 11, according to teachings of the present invention; and, FIG. 14 is a detailed side view of an alternate sinusoid member, indentical to that installed on a conventional guitar in FIG. 11.
Figure 14:
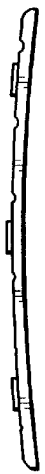

FIG. 12 shows steps required for installation of the original, including mounting and placement of a plurality of screws. FIG. 13 likewise shows a top view, while FIG. 14 shows the side view.

What is claimed is:

1. A stock-like fixed sinusoidal nut member for use with a guitar having a neck with a fretboard having frets on it, having a plurality of indentations for receiving the strings of a guitar, whereby placing the member underneath the string of the guitar in abutting contact with the fretboard, from at least about 0.80 inches to about 1.80 inches from a first fret of a guitar enables a constant string length to be maintained along the fretboard.

2. The stock-like fixed sinusoid as defined in claim 1, whereby the distance is at least about 0.85 inches from a first fret of the guitar.

3. The stock-like fixed sinusoid as defined in claim 1, whereby the distance is at least about 0.95 inches from a first fret of the guitar.

4. The stock-like fixed sinusoid as defined in claim 1, whereby the distance is at least about 1 inch from a first fret of the guitar.

5. The stock-like fixed sinusoid as defined in claim 1, whereby the distance is about 1.333 inches from a first fret of the guitar.

6. The stock-like fixed sinusoid as defined in claim 1, whereby the distance is about 1.5 inches from a first fret of the guitar.

7. The stock-like fixed sinusoid as defined in claim 1, whereby the distance is about 1.85 inches from a first fret of the guitar.

8. An apparatus for maintaining a pythagoran mathematical relationship between string lengths along a fretboard for use with a guitar comprising a sinusoidally curved member which bracingly enages strings of a guitar within respective string wells permitting a desired string tension to be maintained.

9. Apparatus of claim 8, further comprising a plastic member which is placed between a proximal end of a guitar neck and a first fret.

10. Apparatus of claim 8, further comprising a means for receiving guitar strings under tension which enables the strings to be at least one of played, strummed and picked withouth concomitant changes in tension or position.

11. A method of installing a tuning amelioration device for a guitar having a fretboard with a plurality of frets further comprising the steps of:

providing a fixed sinusoidal member having respective notches for receiving strings;

positioning the member a fixed distance between the proximal end of the guitars' neck portion and a first fret of a fretboard, and, adjusting the string tensions to desired levels.

12. The method of claim 11, the providing step further comprising aligning the fixed sinusoidal member at a position parallel to each of the frets of the fretboard.

13. The method of claim 11, the positioning step further comprising aligning the fixed sinusoidal member at a position whereby each of the respective strings is arrayed in a respective notch of the fixed sinusoidal member.

14. The method of claim 11, the adjusting step further comprising tightening the strings relative to the fixed sinusoidal member to produced a desired intonation.

15. The method of claim 11, the positioning step further comprising aligning the fixed sinusoidal member at a position, whereby the distance is at least about 0.85 inches from a first fret of the guitar.

16. The method of claim 11, the positioning step further comprising aligning the fixed sinusoidal member at a position, whereby the distance is about 1 inch from a first fret of the guitar.

17. The method of claim 11, the positioning step further comprising aligning the fixed sinusoidal member at a position, whereby the distance is at least about 1.15 inches from a first fret of the guitar.

18. The method of claim 11, the positioning step further comprising aligning the fixed sinusoidal member at a position, whereby the distance is at least about 1.25 inches from a first fret of the guitar.

19. The method of claim 11, the positioning step further comprising aligning the fixed sinusoidal member at a position, whereby the distance is at least about 1.333 inches from a first fret of the guitar.

20. The method of claim 11, the postioning step further comprising aligning the fixed sinusoidal member at a position, whereby the distance is greater than about 1.50 inches from a first fret of the guitar.

* * * * *

US006583346C1

(12) EX PARTE REEXAMINATION CERTIFICATE (10801st)

United States Patent

Lojacono

(10) Number: US 6,583,346 C1

(45) Certificate Issued: Feb. 1, 2016

(54) STOCK-LIKE SINUSOID MEMBERS FOR TUNING A GUITAR

(76) Inventor: Richard Lojacono, Paso Robles, CA (US)

Reexamination Request:
No. 90/013,440, Feb. 4, 2015

Reexamination Certificate for:

| | |
|---|---|
| Patent No.: | **6,583,346** |
| Issued: | **Jun. 24, 2003** |
| Appl. No.: | **09/946,862** |
| Filed: | **Sep. 4, 2001** |

Related U.S. Application Data

(63) Continuation-in-part of application No. 29/097,840, filed on Nov. 14, 1998, now abandoned.

(51) Int. Cl.

| | |
|---|---|
| ***G01D 3/06*** | (2006.01) |
| ***G10D 3/14*** | (2006.01) |

(52) U.S. Cl.
CPC ..... *G10D 3/14* (2013.01)

(58) Field of Classification Search
None
See application file for complete search history.

(56) References Cited

To view the complete listing of prior art documents cited during the proceeding for Reexamination Control Number 90/013,440, please refer to the USPTO's public Patent Application Information Retrieval (PAIR) system under the Display References tab.

*Primary Examiner* — Eron J Sorrell

(57) ABSTRACT

A stock-like fixed sinusoidally curved and shaped member is effective for maintaining a zero cent condition and keeping the relative and respective string lengths and individuated pitches and tones contant in any conventional guitar on which the present invetion is installed, methods and kits are likewise disclosed.

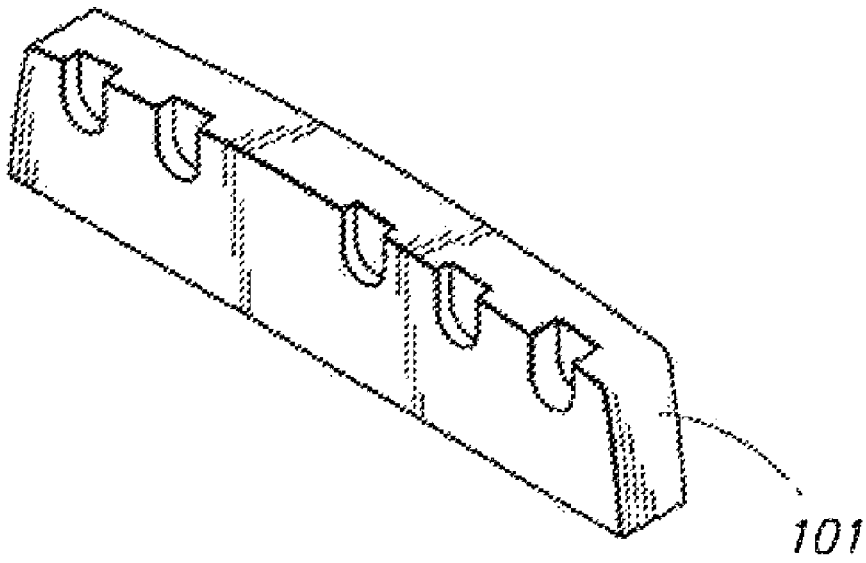

EX PARTE REEXAMINATION CERTIFICATE

THE PATENT IS HEREBY AMENDED AS INDICATED BELOW.

AS A RESULT OF REEXAMINATION, IT HAS BEEN DETERMINED THAT:

Claims 1-20 are cancelled.

* * * * *